US006604299B1

(12) United States Patent
Libassi

(10) Patent No.: US 6,604,299 B1
(45) Date of Patent: Aug. 12, 2003

(54) ATHLETIC SHOE WITH A SOLE EXTENSION

(76) Inventor: Steven A. Libassi, 6521 Mill Run Cir., Roanoke, VA (US) 24018

( * ) Notice: Subject to any disclaimer, the term of this patent is extended or adjusted under 35 U.S.C. 154(b) by 0 days.

(21) Appl. No.: 09/544,259

(22) Filed: Apr. 6, 2000

(51) Int. Cl.[7] ..... A43B 5/00; A43B 13/04; A43B 13/28

(52) U.S. Cl. ..... 36/25 R; 36/133; 36/32 R

(58) Field of Search ..... 36/25 R, 103, 36/109, 113, 114, 128, 133, 4, 14, 21, 22 A, 32 R, 7.1 R, 7.3, 8.1, 112, 97

(56) References Cited

U.S. PATENT DOCUMENTS 447,497 A * 3/1891 Smith
546,323 A 9/1895 Harland
590,295 A * 9/1897 Brockman
1,622,860 A * 3/1927 Cutler
1,803,554 A * 5/1931 Knilans
2,587,300 A 2/1952 Everston
3,444,572 A * 5/1969 Broughton
3,618,235 A * 11/1971 Cary, Jr.
4,389,798 A * 6/1983 Tilles ..... 36/32 R
4,559,723 A * 12/1985 Hamy et al. ..... 36/102
4,813,158 A * 3/1989 Brown ..... 36/114
4,899,470 A 2/1990 Holland, III
5,216,827 A * 6/1993 Cohen ..... 36/114
5,570,523 A * 11/1996 Lin ..... 36/97
6,047,434 A * 4/2000 Falwell ..... 36/9 R

* cited by examiner

*Primary Examiner*—Anthony D. Stashick
(74) *Attorney, Agent, or Firm*—Bacon & Thomas, PLLC

(57) ABSTRACT

An athletic shoe having a sole extension extending substantially from the bottom sole to substantially overlap front portions of the shoe sidewalls including the toe enclosing portion, towards and closely adjacent the lacing area. Side seams secure the rear portion of the sidewalls to the bottom sole and upper seams extend from the side seams over the middle and front portions of the sidewalls along the outer edges of the sole extension and secure the sole extension to the sidewalls.

3 Claims, 4 Drawing Sheets

ATHLETIC SHOE WITH A SOLE EXTENSION

BACKGROUND OF THE INVENTION

1. Field of the Invention

The present invention relates to athletic shoes with one or more sole extensions that extends upwardly from the outer bottom sole in order to protect particular portions of the shoe surface.

2. Discussion of the Related Art

The related art of interest describes shoe devices designed for protecting various portions of the shoe. In general, these shoe devices are designed to resist wear at particular surfaces of the shoe or from surfaces for specific use, such as a ball kicking surface. Such prior athletic shoe devices substantially deviate from the standard shapes for modern athletic shoes and hence they may not be aesthetically pleasing. Further, the weight and increased bulk inherent in such athletic shoe devices reduce comfort to the wearer of the shoes as well as increase their manufacturing costs.

U.S. Pat. No. 4,899,470 to Holland III discloses an athletic shoe with control surfaces formed from a vertically enhanced outer sole. The sole extension adds substantial bulk to the shoes thereby reducing the agility of the wearer. The sole extension does not extend upwardly beyond the kicking surfaces and thus the outer terminal edges of the sole extension are vulnerable to external contacts and would likely result in premature separation of the sole from the sidewalls or uppers of the shoe.

U.S. Pat. Nos. 546,323 and 2,587,300 both show a very elementary concept of extending an outer sole over only the toe portion of the shoe to provide added wear-resistant surfaces.

FIG. 1 shows a perspective view of a prior art athletic shoe. It shows a bottom outer sole 30 having a front portion 30*a* and a rear portion 30*b*. The upper side and top portions 14*a*, 14*b* (as shown in FIG. 2) are stitched to the outer periphery of the outer sole 30 by side seams 50. However the side seams 50 are located on the preferred contact surfaces of athletic shoes for contacting external items such as a soccer ball. The main disadvantage of the prior art athletic shoe is that the side seams 50 are exposed to direct and frequent contacts with the external environment resulting in early deterioration of the side seams 50 before the other components of the shoe are worn out. Thus with the unraveling of the side seams 50 due to frequent contacts, prior art athletic shoes resulted in the separation of the upper side and top portions 14*a*, 14*b* from the outer sole 30, and had to be prematurely discarded when other parts of the shoes were relatively free from wear. FIG. 1 also show a shoe tongue 10 attached to the front of the shoe and cleats 35 attached to the lower surface of the outer sole 30.

FIG. 2 is a plan view of a prior art athletic shoe. It shows left and right upper side and top portions 14*a*, 14*b* as well as the toe enclosing upper portion 15. The side seams 50 are formed along the outer periphery of the outer sole 30. Traditional side seams 50 are vulnerable to contacts with external objects such as a soccer ball, since the side seams 50 are located at surfaces that are subjected to frequent contacts, such as preferred kicking surfaces for a soccer shoe. Hence, a need is seen to create an athletic shoe which advantageously delays the separation of the seams that attach the upper side and top portions 14*a*, 14*b* to the sole 30, thereby extending the life of the athletic shoe. FIG. 2A is a sectional view taken along lines IIA—IIA of FIG. 2.

FIG. 2A more clearly shows the location of the side seams 50 which secures the upper portions 14*a*, 14*b* to the outer sole 30, and the vulnerability of the side seams 50 to external contacts. The reference numbers for the prior art figures (1, 2 and 2A) are also used in the figures representative of the present invention.

In a sport in which the athletic shoe comes into frequent sidewall contacts, for instance in the game of soccer where the shoes are used as a kicking implement, it would be highly desirable to extend the life of the athletic shoe in order to delay the purchase of replacement shoes. In soccer, the preferred kicking surfaces on the shoe coincides with the location of traditional seams that attach the outer sole to the uppers (on the outer periphery of the sole). Thus soccer shoes, in particular, are quickly discarded when the seams deteriorate due to frequent contact with the soccer ball, other shoes or the playing field.

Accordingly, there is a need for an athletic shoe that retains the basic contours of the athletic shoe while at the same time delays the separation of the side seams that attach the outer sole to the uppers and the toe enclosing portions of the shoe upper, thereby extending the life of the athletic shoe. A need is seen to reduce the exposure of the seams in parts of the shoe that are frequently rubbed against in order to delay the deterioration of the seams.

SUMMARY OF THE INVENTION

The present invention provides an athletic shoe including an outer sole having an outer periphery, an upper that is attached to the outer periphery of the outer sole and a sole extension that extends upwardly substantially from the outer periphery of a front portion of the outer sole to overlap the front portions of the uppers as well as a toe enclosing potion. Upper seams are provided to secure the sole extension to the shoe upper on the top side of the shoe adjacent lacing margin areas having lacing eyelets provided on the shoe upper portions centrally of the shoe so as to minimize the chance of contact between the upper seams and the external environment, such as a soccer ball in order to extend the life of the upper seams, which in turn extends the service life of the shoe.

The sole extension can either overlap the front upper portion of the athletic shoe or it can essentially become the front upper of the athletic shoe, as well as the toe extension portion.

BRIEF DESCRIPTION OF THE DRAWINGS

In order to more fully explain the features and advantages of the present invention, the following preferred embodiments of an athletic shoe with a sole extension according to the invention are described, as examples only without any limitative character, with reference to the accompanying drawings, in which.

DETAILED DESCRIPTION OF THE PREFERRED EMBODIMENTS

The present invention is an athletic shoe that incorporates an outer sole extension that extends upwardly over the front portions of the shoe upper including the toe enclosing portion of the shoe upper. Seams that attach the outer sole extension to the upper front portions extend toward the lacing margin area of the shoe upper portions on the top side of the shoe, such that the seams are positioned in locations that are less likely to contact external objects during sporting activities, such as the ground or a soccer ball. Embodiments of the various aspects of the present invention will now be explained with references to the accompanying drawings.

Figure 3:
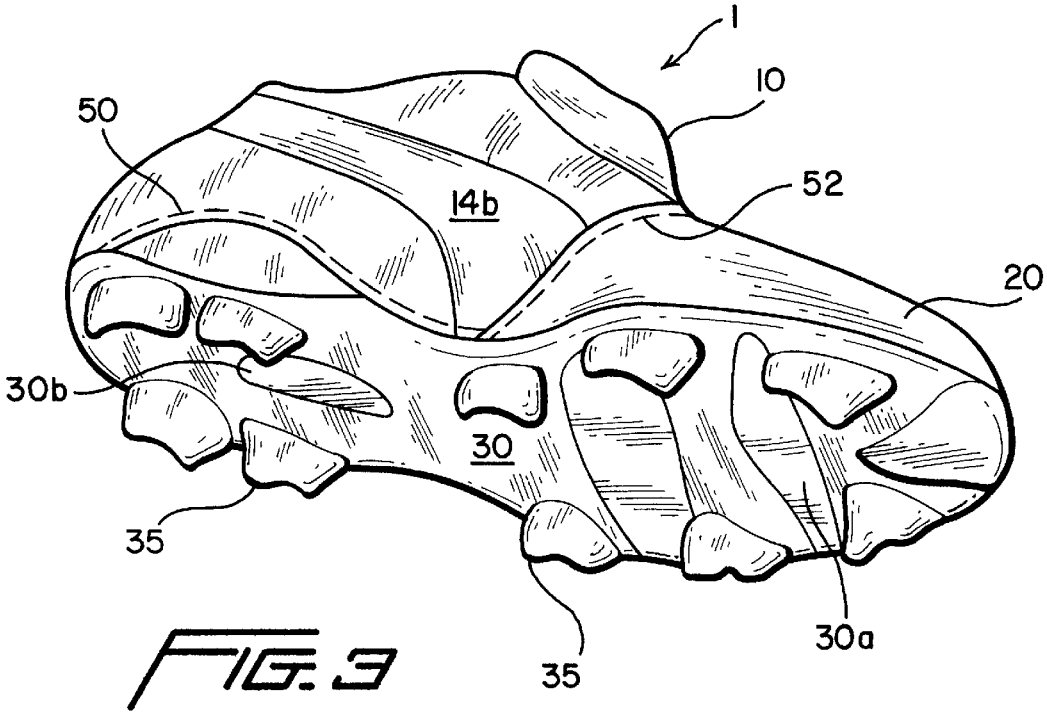
FIG. 3 is a perspective view of a preferred embodiment of the athletic shoe of the present invention.

FIG. 3 is a perspective view of an embodiment of the present invention. FIG. 3 shows an outer sole extension 20 that extends upwardly from the outer bottom sole 30 towards and closely adjacent the central lacing margin area 16 of the side and top upper portions 14*a*, 14*b* following the contours of the upper of the shoe 1. Lacing margin area or lacing margin 16 defines a tongue opening 16*b* beneath which tongue 10 extends. Lacing eyelets 16*a* are provided in the lacing margin 16 of upper portions 14*a*, 14*b*. The outer sole extension, as seen in FIG. 5*a*, is formed as a single piece with the outer bottom sole 30. The side seam 50 which secures the bottom sole 30 to the upper portions 14*a*, 14*b*, in the prior art shoe of FIG. 1, extends upward near the middle outer periphery of the outer sole 30 to become upper seams 52 that attach the sole extension 20 to the rest of the shoe including upper side and top portions 14*a*, 14*b* and the toe enclosing portion 15 near the lacing margin 16 located centrally above the middle part of the outer sole on the top side of the shoe. Instead of seams 50 or 52, an adhesive such as a shoe glue can be used to attach the upper portions 14*a*, 14*b* to the bottom sole 30.

The athletic shoe of FIG. 3 minimizes the exposure of the upper seams 52 to frequent contacts during sporting activities such as soccer since in soccer for instance, the upper seams 52 will be centrally located on the top area of the shoe and far removed from preferred kicking or contact surfaces. The result is that the athletic shoe of the present invention will maintain the seam connections between the outer sole 30 and the upper portions 14*a*, 14*b* and toe enclosing portion 15 much longer than the standard seams and sole configuration of the prior art.

The athletic shoe of FIG. 3 includes an outer sole 30, and for illustrative purposes, the sole 30 is divided into front and rear portions 30*a*, 30*b*. The sole includes a sole extension 20 which extends upwardly substantially from the outer periphery of the front portion 30*a* of the sole 30 over the upper portions 14*a*, 14*b*, toe enclosing portion 15 and toward the lacing margin where it terminates closely adjacent the lacing margin 16 area and eyelets 16*a*. It is also envisioned that the sole extension 20 can extend from the rear portion 30*b* of the outer sole 30 as well, although such a configuration would require additional sole extension material (not shown).

Upper portions 14*a*, 14*b* are attached to the outer periphery of the outer sole 30, and the portions 14*a*, 14*b* converge toward the front of the shoe to form a toe enclosing portion 15 at the front of the shoe 1, and a central lacing margin area 16 on the top of the shoe is also formed by the upper portions 14*a*, 14*b*. The sole extension 20 extends substantially from the outer periphery of the front portion 30*a* of the bottom sole 30 and overlaps the upper portions 14*a*, 14*b*, and the toe enclosing portion 15, extending towards and closely adjacent the lacing margin area 16.

Figure 1:
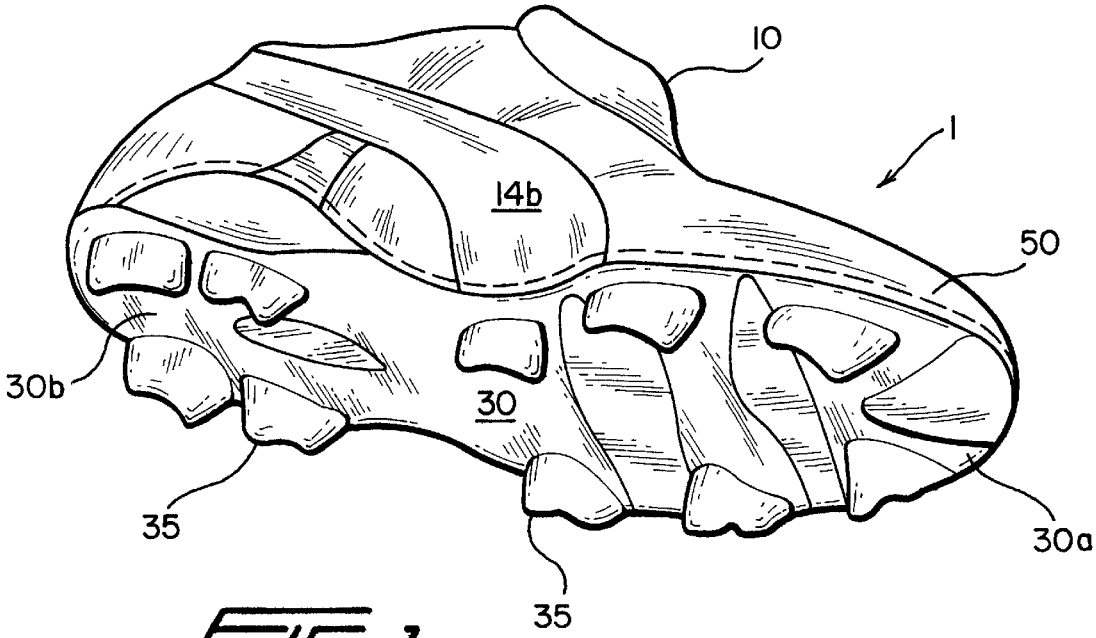
FIG. 1 (PRIOR ART)
FIG. 1 is a perspective view of a prior art athletic shoe.
Figure 2:
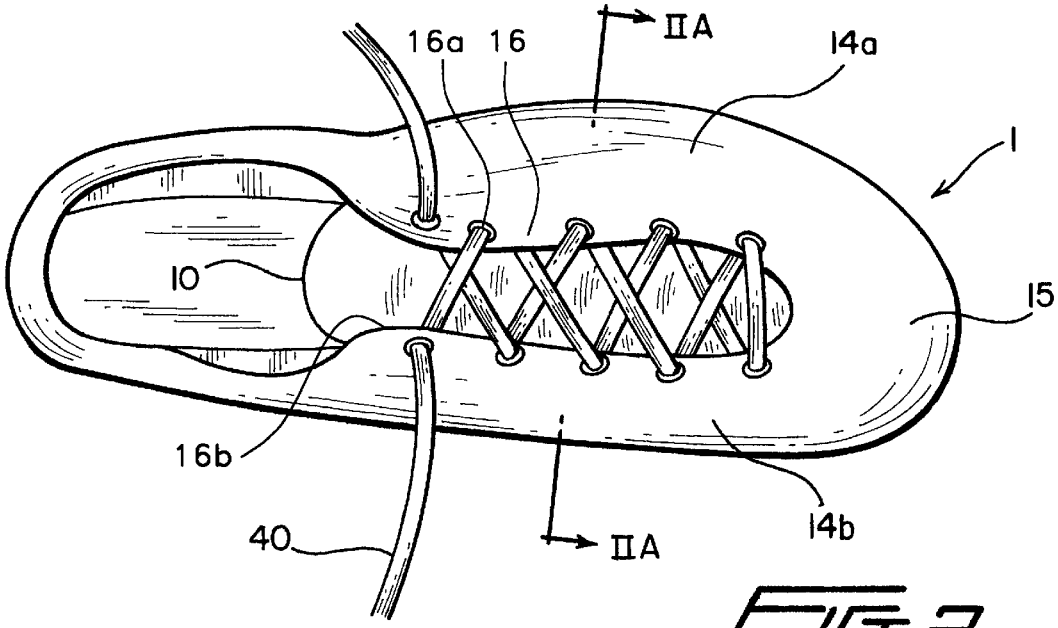
FIG. 2 (PRIOR ART)
FIG. 2 is a plan view of a prior art athletic shoe.
Figure 2A:
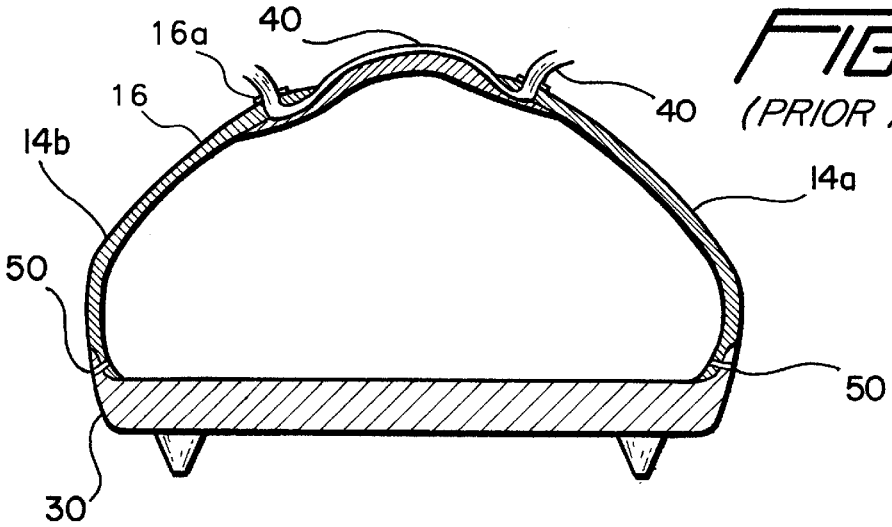
FIG. 2A (PRIOR ART)
FIG. 2A is a sectional view taken along lines IIA—IIA of FIG. 2.

The upper seams 52 are positioned well away from the traditional seam locations (as seen in FIG. 1) that are frequently contacted surface areas of the shoe, thereby minimizing the wear to the upper seams 52, and permitting the extended usage of the shoe 1. Similar to the side seams 50, the upper seams 52 can be substituted for or used in combination with an adhesive such as a shoe glue. In such case, care must be made to securely adhere the outer terminal edges 23 of the sole extension 20 to the upper portions 14*a*, 14*b*, and 15 in order to prevent the sole extension 20 from prematurely detaching from the upper.

Figure 4:
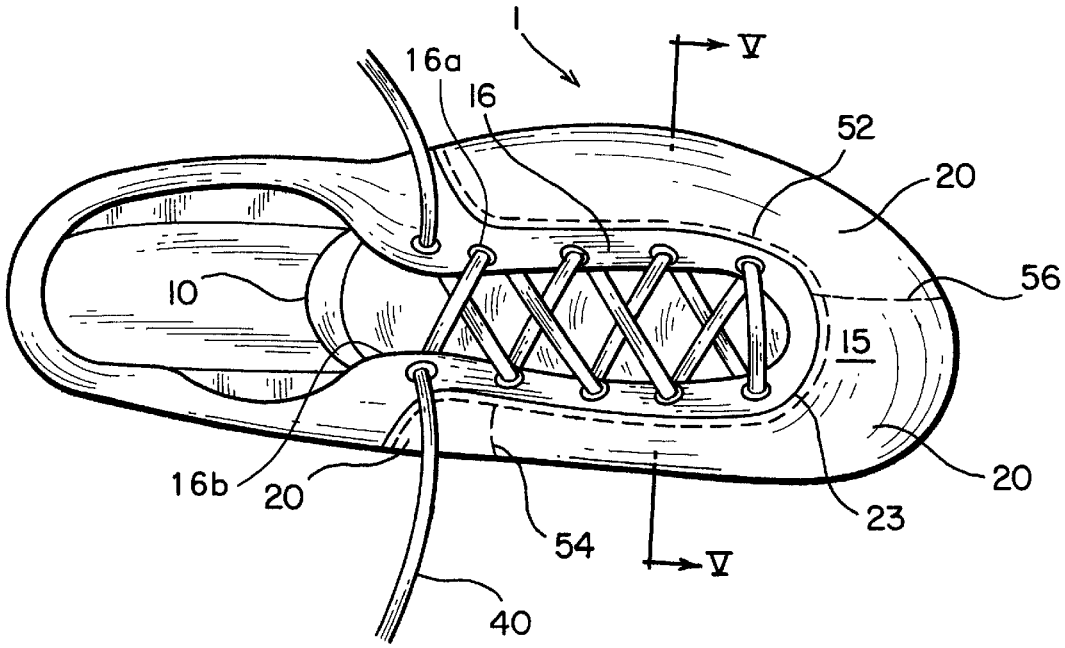
FIG. 4 is a plan view of the athletic shoe of FIG. 3.

FIG. 4 is a plan view of the athletic shoe of FIG. 3. FIG. 4 shows the general outer periphery of the outer sole 30. The sole extension 20 extends upwardly substantially from the outer periphery of the front portion 30*a* of the sole 30 towards, and closely adjacent the lacing margin area 16 overlapping a large segment of the upper portions 14*a*, 14*b* and the toe enclosing portion 15. Upper seams 52 extend from the side seams 50 substantially formed on the outer periphery of the rear portion 30*b* of the outer sole 30 toward the lacing margin area 16 and around the toe enclosing portion 15 to secure the sole extension 20 to the upper portions 14*a*, 14*b* and the toe enclosing portion 15 along the terminal edges 23 of the sole extension 20. The shoe lace 40 is shown with the sole extension 20 closely contouring the lacing margin area 16.

The athletic shoe may further include one or more reinforcement seams 54 that preferably extend vertical between the upper and the bottom sole in order to further reinforce the attachment of the sole extension 20 to the upper portions 14*a*, 14*b*. In addition, front reinforcement seam 56 may extend from the front of the outer sole 30 upwardly towards the lacing margin area 16, toward the upper seam 52 in order to further reinforce the attachment of the sole extension 20 to the toe enclosing upper portion 15 of the shoe 1.

FIG. 5A is a cross-sectional view taken along lines V—V of the FIG. 4. FIG. 5A shows an embodiment of the present invention in which the sole extension 20 extends from the outer periphery of the outer sole 30 towards and terminates at terminal edges 23 closely adjacent the lacing margin area 16. Upper portions 14*a*, 14*b* also extend from the outer periphery of the sole bottom 30 up to and including the lacing margin area 16 as well, such that the front portions 14*a*, 14*b*, 15 of the uppers are substantially overlapped by the sole extension 20. The upper portions 14*a*, 14*b* may further be attached to the sole extension 20 by the use of adhesives or by other commonly known bonding methods that would be readily apparent to one skilled in the art.

The sole extension 20 shown in FIG. 5A is substantially uniform in its thickness as it covers the portion of the upper portions 14*a*, 14*b*. However, it is envisioned that the thickness of the sole extension 20 may vary depending on the needs of the athlete or the particular type of sport. For instance, in soccer, kicking surfaces of the shoe may require greater thickness to extend wear and enhance performance.

Figure 5B:
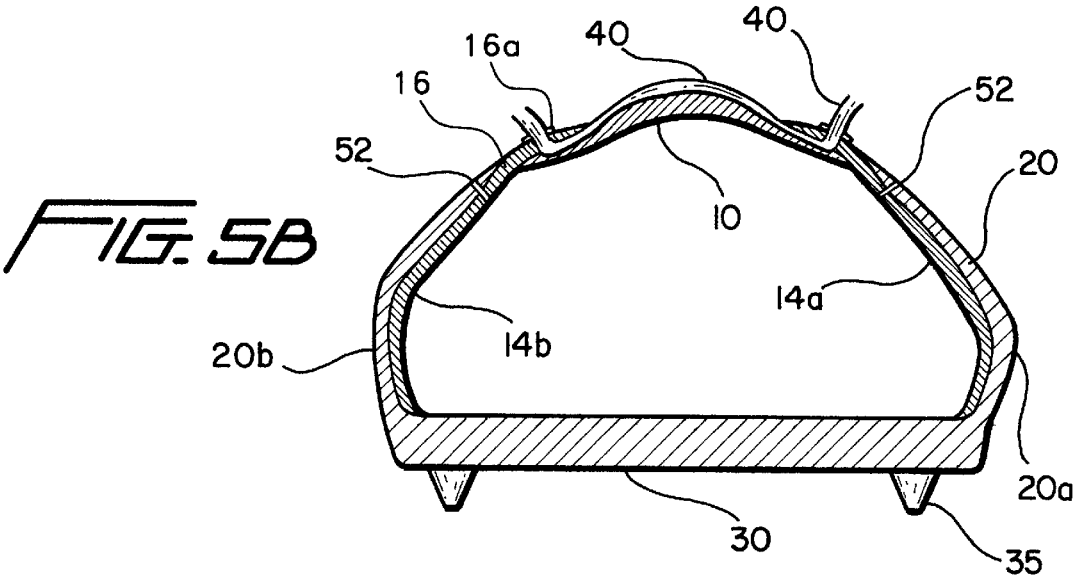
FIGS. 5A–5D are sectional views of various embodiments of the present invention, taken along line V—V of FIG. 4.
Figure 5A:
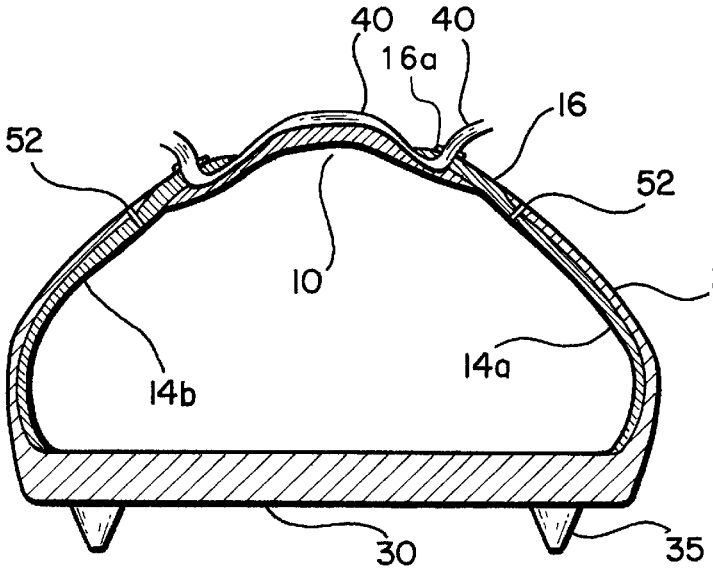

FIG. 5B is cross-sectional view very similar to that of FIG. 5A, except that in this embodiment the thickness of the sole extension 20 is non-uniform and the external surfaces 20*a* may be customized in shape and texture for a particular sport, such as soccer. The purpose of the non-uniform sole extension 20 is to ensure that surface areas that come into frequent contact can be further strengthened by increasing thickness in those areas in the sole extension 20 so that the life of the athletic shoe can further be extended. The extra thickness or unique shapes, such as edge surface 20*b* (as shown in FIG. 5B) of the sole extension 20 may enhance the performance of the athlete wearing the shoe in instances where thicker contact surfaces or special surface shapes may improve the performance of the athlete.

Figure 5C:
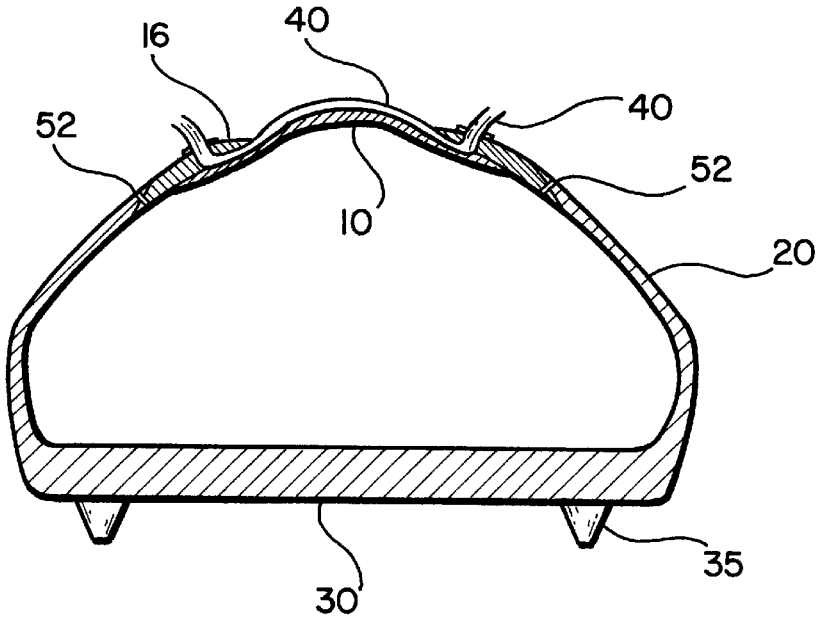
Figure 5D:
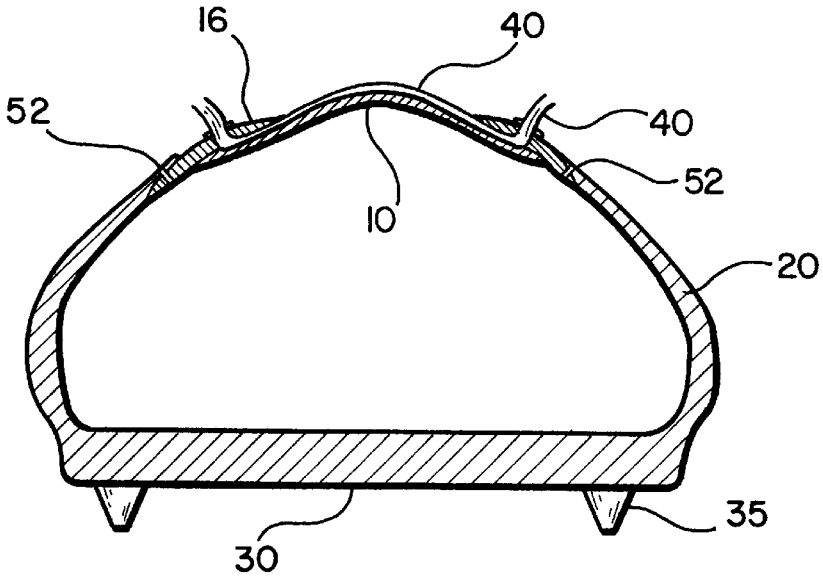

FIGS. 5C and 5D are also cross-sectional views taken along lines V—V of FIG. 4 showing other embodiments.

The distinguishing feature of the embodiments shown in FIGS. 5C and 5D over the earlier embodiments shown in FIGS. 5A and 5B is that in FIGS. 5C and 5D, the sole extension 20 defines part of the upper portions 14*a*, 14*b*, doing away with the overlap of the sole extension 20 over the sidewalls 14*a*, 14*b* as shown in FIGS. 5A and 5B. FIG. 5C shows a sole extension 20 of substantially uniform thickness. The sole extension is secured at its outer terminal edges 23 to the sidewalls by seams and/or adhesive.

FIG. 5D shows a sole extension 20 similar to FIG. 5C with non-uniform thickness. The advantages of a non-uniform thickness sole extension 20 have been discussed earlier and are not repeated here. The advantage of the sole extension 20 with uniform thickness is that it may also contribute to the comfort of the user. In any case, a careful balance of the many features of the invention will result in optimum comfort, performance and durability.

The present invention is by no means restricted to the above-described preferred embodiments, but covers all variations that might be implemented by using equivalent functional elements or devices that would be apparent to a person skilled in the art, or modifications that fall within the spirit and scope of the appended claims.

I claim:

1. An athletic shoe comprising:

an upper including an upper portion having lacing margin areas including lacing eyelets located centrally at the top side of the shoe and a toe enclosing portion;

an outer sole including a front bottom portion, and side extensions extending from the front bottom portion upwardly over and around the upper portion having the lacing margin areas and the toe enclosing portion, said side extensions terminating adjacent lacing eyelets of the lacing margin areas above the sole bottom portion, said front bottom portion and side extensions formed as a single piece;

said side extensions having terminal edges secured to said upper portion by fastening means that at least extend along lines extending along the top side of the shoe adjacent and around said eyelets and said lacing margin area;

whereby at least said fastening means extending along the top side of the shoe are shielded from side impact of the shoe with a game object.

2. An athletic shoe as claimed in claim 1, said side extensions having varying thickness in an area overlapping the upper portion.

3. An athletic shoe comprising:

an upper portion comprising at least a pair of lacing margin areas including lacing eyelets on the top side of the shoe;

an outer sole including a front bottom portion, and upwardly extending side extensions extending upward from said front bottom portion and up to and secured to said lacing margin areas at the top side of the shoe said front bottom portion and side extensions formed as a single piece;

said side extensions solely defining at least part of said shoe upper between a bottom portion of the outer sole and said lacing margins.

* * * * *